US009616484B2

(12) United States Patent
Gekht et al.

(10) Patent No.: US 9,616,484 B2
(45) Date of Patent: Apr. 11, 2017

(54) METHOD AND APPARATUS FOR FORMING A TURBOFAN MIXER

(75) Inventors: Eugene Gekht, Brossard (CA); Danny Mills, Châteauguay (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 1369 days.

(21) Appl. No.: 12/337,714

(22) Filed: Dec. 18, 2008

(65) Prior Publication Data

US 2010/0229618 A1 Sep. 16, 2010

(51) Int. Cl.
*B21D 53/92* (2006.01)
*B21D 13/02* (2006.01)
*B21D 51/10* (2006.01)

(52) U.S. Cl.
CPC ..... *B21D 53/92* (2013.01); *B21D 13/02* (2013.01); *B21D 51/10* (2013.01)

(58) Field of Classification Search
CPC ..... B21D 53/92; B21D 13/10; B21D 13/02; B21D 17/02; B21D 51/10; B21D 15/02; B21D 51/12; B21D 51/34; B21D 51/28; B21D 13/00; B23P 15/006; B23P 2700/13
USPC ..... 72/399, 402, 403, 370.13, 379.2, 400, 72/235, 353.6, 325, 414, 370.01, 370.04, 72/401, 344, 354.2, 370.05, 85, 367.1, 72/368; 29/889.3, 889.4
IPC ..... B23P 15/006,2700/13
See application file for complete search history.

(56) References Cited

U.S. PATENT DOCUMENTS 565,257 A * 8/1896 Boyd ..... 72/402
1,159,322 A 11/1915 Livingston
2,169,025 A 8/1939 Forbes
3,707,133 A * 12/1972 Myer ..... 72/335
3,748,674 A * 7/1973 Powell et al. ..... 470/18
3,783,483 A 1/1974 Ivey
3,793,865 A 2/1974 Krabacher
3,831,675 A 8/1974 McLain
3,861,140 A 1/1975 Krabacher
3,910,212 A * 10/1975 Konoki ..... B21D 51/34 413/27
3,921,883 A 11/1975 McLain
4,149,375 A 4/1979 Wynosky et al.
4,395,815 A 8/1983 Stanley et al.
4,416,142 A * 11/1983 Thorne-Thomsen ..... 72/348
4,481,698 A * 11/1984 Salerno ..... 29/889.22
4,766,657 A 8/1988 Singer
4,872,612 A 10/1989 Singer
4,876,876 A * 10/1989 Ishida et al. ..... 72/348
5,444,912 A 8/1995 Folmer
5,634,367 A * 6/1997 Yamada et al. ..... 72/402
6,058,696 A 5/2000 Nikkanen et al.
6,463,992 B1 10/2002 Dowhan et al.
7,043,898 B2 5/2006 Rago
2008/0267780 A1 10/2008 Wirth

FOREIGN PATENT DOCUMENTS

SE WO 2005/121582 * 12/2005

* cited by examiner

*Primary Examiner* — Moshe Wilensky
*Assistant Examiner* — Mohammad Yusuf
(74) *Attorney, Agent, or Firm* — Norton Rose Fulbright Canada LLP

(57) ABSTRACT

The method for forming a turbofan mixer comprises providing a single monolithic and generally flat annular sheet metal blank, providing a die surface substantially corresponding in shape to a turbofan mixer shape, positioning the blank with reference to the die surface, and forcing the blank against the die surface to transform the blank into a monolithic turbofan mixer.

6 Claims, 4 Drawing Sheets

METHOD AND APPARATUS FOR FORMING A TURBOFAN MIXER

TECHNICAL FIELD

The technical field relates to mixers for use in turbofan gas turbine engines.

BACKGROUND

In the production of aircraft engines, the geometric complexity of sheet metal components and the accuracy required can be very challenging. An example of a complex sheet metal component is an exhaust mixer of a turbofan gas turbine engine. This component is provided to mix the cold bypass flow and hot engine core flow at the aft of the engine. The inner surface of the turbofan mixer is designed to alter the outer portion of the engine core flow and the outer surface of the turbofan mixer is designed to alter the inner portion of the by-pass flow. These flow alterations result in an improved mixing of the two flows behind the engine. Turbofan mixers are often fabricated by cutting and forming individual segments in a sheet metal die press, then assembling the individual segments together in a complex welding jig. This procedure can be very time consuming and very demanding in terms of craftsmanship. Needs for improvements in this area exist.

SUMMARY

In one aspect, the present concept provides a method of forming a turbofan mixer, the method comprising: providing a single monolithic and generally flat annular sheet metal blank; providing a die surface substantially corresponding in shape to a turbofan mixer shape; positioning the blank with reference to the die surface; and forcing the blank against the die surface to transform the blank into a monolithic turbofan mixer.

In another aspect, the present concept provides an apparatus for forming turbofan mixers from monolithic sheet metal blanks, the apparatus comprising: a die having a central axis, the die including a plurality of outwardly-projecting and circumferentially disposed bulges provided around a central core of the die, each two adjacent bulges having a respective channel therebetween, the die having an outer shape substantially corresponding to a turbofan mixer interior shape; and a plurality of circumferentially-disposed strikers provided around the die, each striker in registry with a respective one of the channels, the strikers being movable substantially simultaneously with reference to the die.

Further details of these and other aspects will be apparent from the detailed description and figures included below.

DETAILED DESCRIPTION

Figure 1:
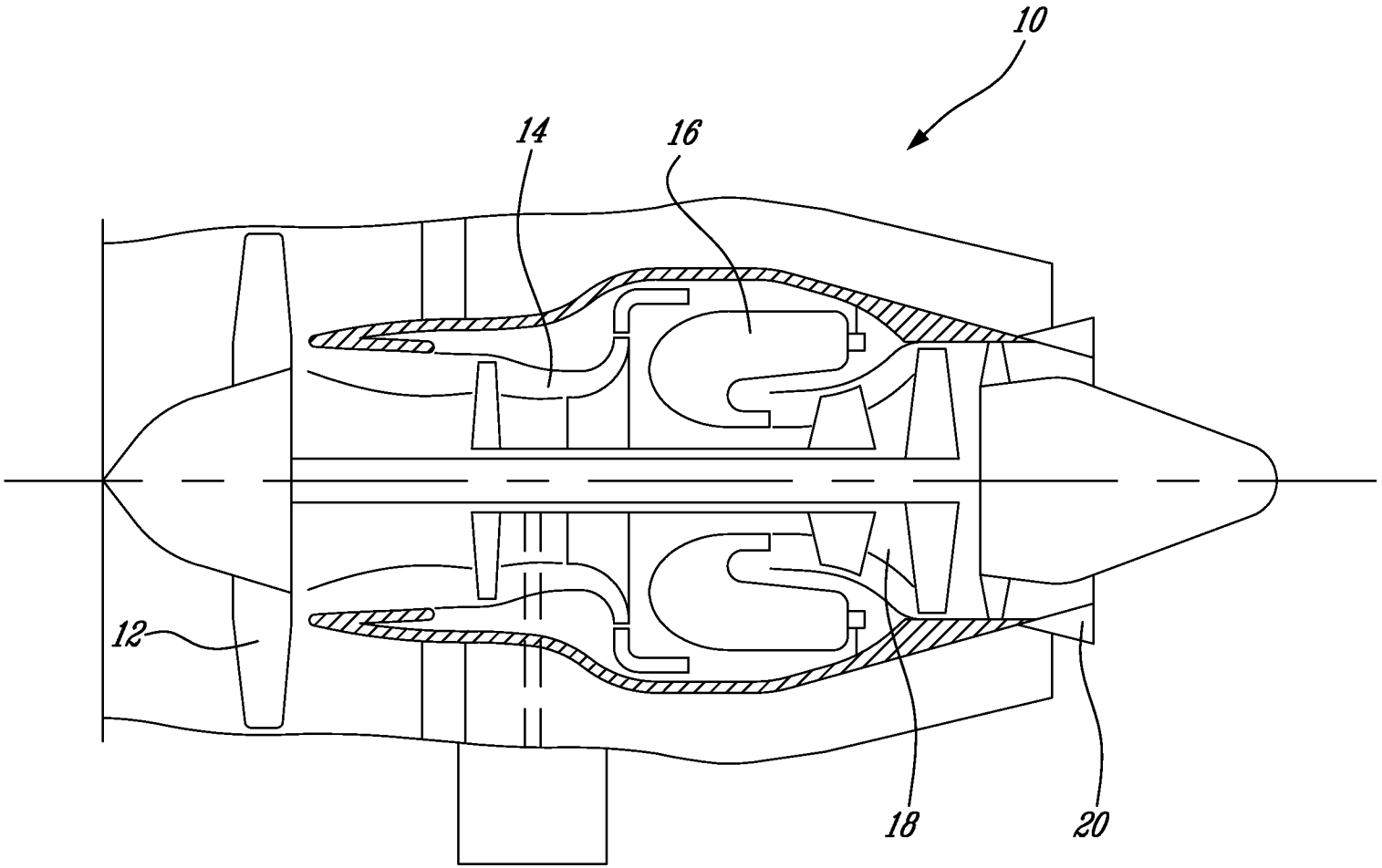
FIG. 1 is a semi-schematic cross-section view showing an example of a turbofan gas turbine engine provided with a mixer.

FIG. 1 illustrates an example of a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The engine 10 includes a mixer 20 provided at the aft thereof. It should be noted that FIG. 1 only illustrates one example of a turbofan gas turbine engine. A turbofan mixer can be provided in other kinds of gas turbine engines.

Figure 2:
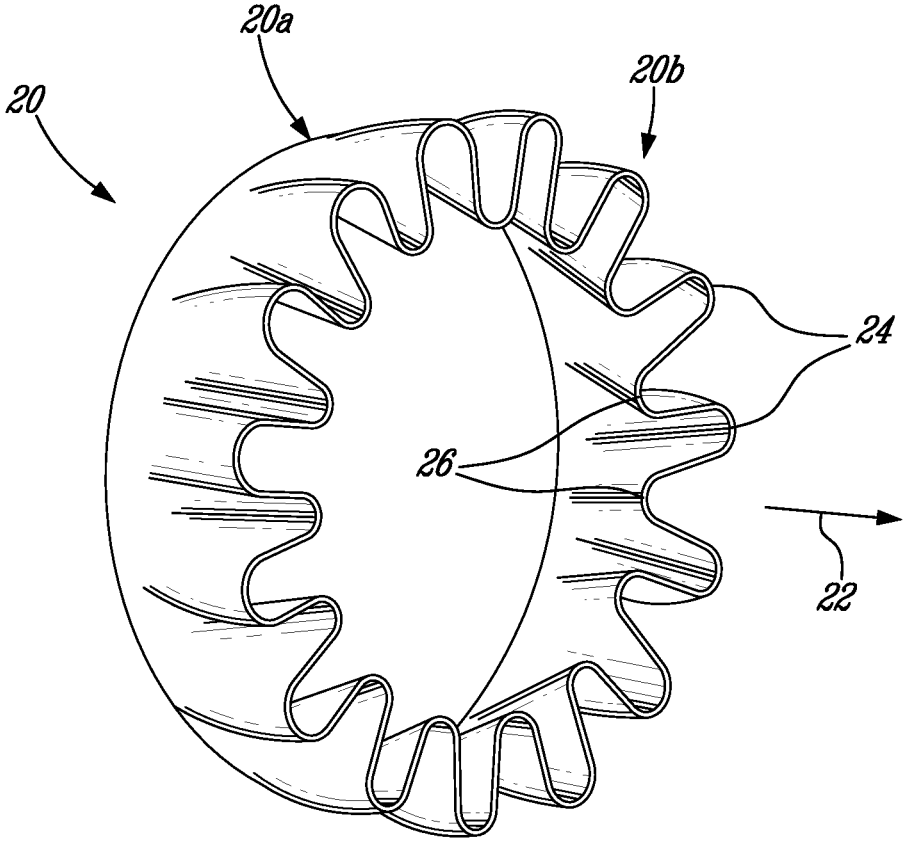
FIG. 2 is an isometric view showing an example of a turbofan mixer.

FIG. 2 shows an example of a monolithic turbofan mixer 20. The turbofan mixer 20 illustrated in FIG. 2 is made from a monolithic blank shaped into a turbofan mixer using a method and an apparatus as described hereafter. The turbofan mixer 20 includes a front end portion 20*a* and a rear end portion 20*b* with reference to the core and by-pass flow direction, which direction is depicted in FIG. 2 with arrow 22. The front end portion 20*a* is generally circular but variants are also possible.

As can be seen, the turbofan mixer 20 includes a plurality of intercalated outward and inward mixer lobes 24, 26 circumferentially distributed around the periphery of the rear end portion 20*b*. Outward mixer lobes 24 can be axisymmetric or not all around the circumference, depending on the design. Likewise, inward mixer lobes 26 can be axisymmetric or not all around the circumference, depending on the design. The exact mixer lobe pattern is something that a skilled turbofan mixer designer will know how to create and does not need to be further discussed herein.

Figure 3:
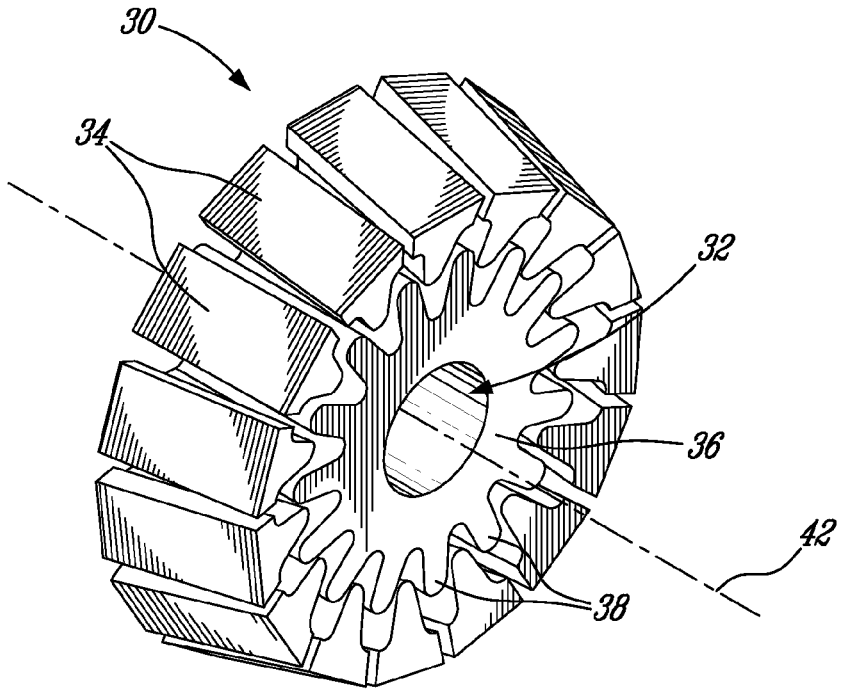
FIG. 3 is a semi-schematic exploded view showing a simplified example of an apparatus for forming a turbofan mixer as described herein.

FIG. 3 is a semi-schematic exploded view showing a simplified example of an apparatus 30 for forming a turbofan mixer as shown for instance in FIG. 2. The apparatus 30 comprises a generally circular die 32 and a plurality of circumferentially-disposed strikers 34 surrounding the die 32. The die 32 comprises a central core 36 surrounded on its periphery by a plurality of spaced-apart and circumferentially-disposed bulges 38 projecting outwardly and separated from each other by channels 40. The bulges 38 and the channels 40 form a die surface located on the outer side of the die 32. The bulges 38 correspond in number and shape to the outward mixer lobes 24 of the turbofan mixer 20. The exact shape and position of the individual bulges 38 depend at least in part on the desired shape of the turbofan mixer 20. The die 32 has a central axis 42 which will correspond to the central axis of each newly-formed turbofan mixer before being pulled away from the die 32 at the end of the forming process.

Figure 4:
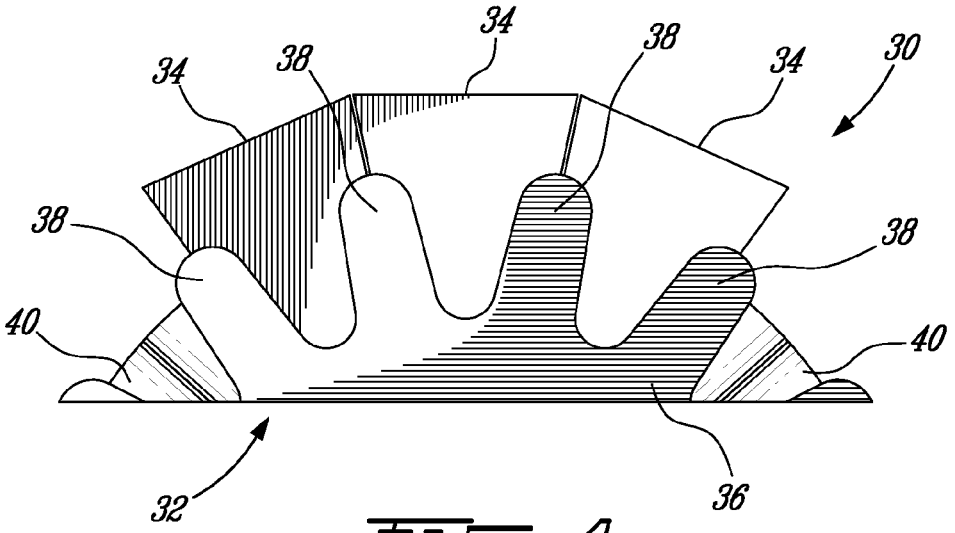
FIG. 4 is an enlarged view showing a portion of the rear of the die and some of the strikers at the end of a forming stroke of the apparatus illustrated in FIG. 3.

The strikers 34 correspond in number to the inward mixer lobes 26 of the turbofan mixer 20. Each striker 34 is substantially in registry with a respective channel 40 formed between each two adjacent bulges 38. Each striker 34 also has an interior portion that cooperates with the corresponding channel 40 and the sides of the bulges 38. It should be noted that FIG. 3 is an exploded view so that the strikers 34 are shown radially farther from the die 32 for the purpose of illustration. FIG. 4 is an enlarged view showing a portion of the rear of the die 32 and some of the strikers 34 at the end of a forming stroke of the apparatus 30 illustrated in FIG. 3. Two of the channels 40 are visible in FIG. 4. It should be noted that FIGS. 3 and 4 show the apparatus 30 being empty (i.e. without a blank therein). Also, FIG. 4 shows that the interior shape of each striker 34 corresponds to the shape of the corresponding channel 40 and the sides of the adjacent bulges 38. Variants, however, are possible. For instance, the complementary shapes can be different over a portion of their length or over their full length.

Figure 5:
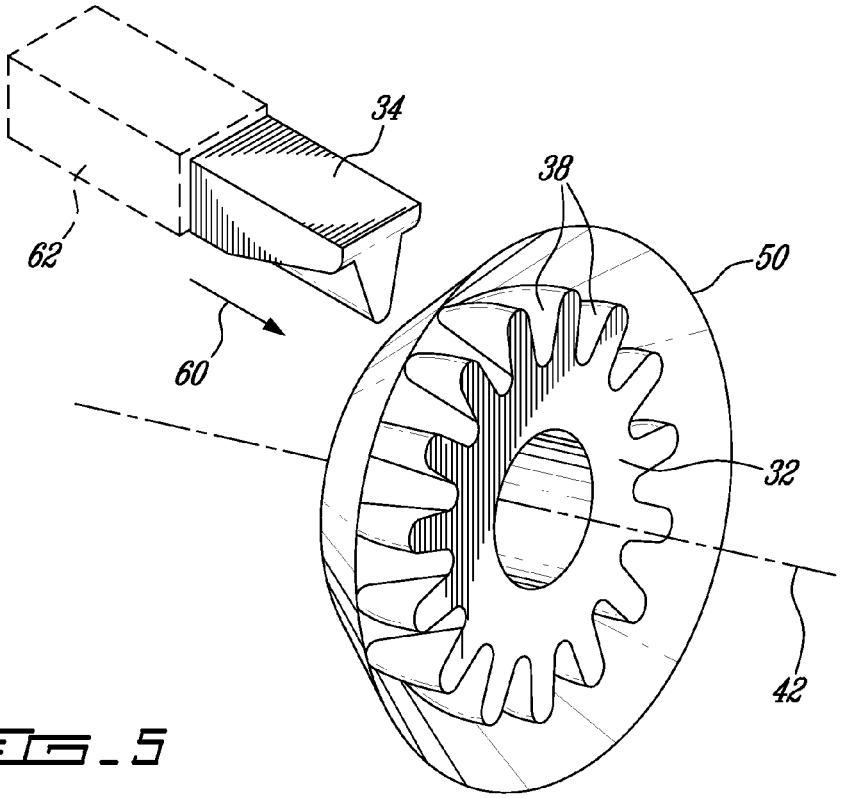
FIG. 5 is a semi-schematic view showing one of the strikers of the apparatus illustrated in FIG. 3 pressing against a blank positioned over the front of the die.
Figure 6:
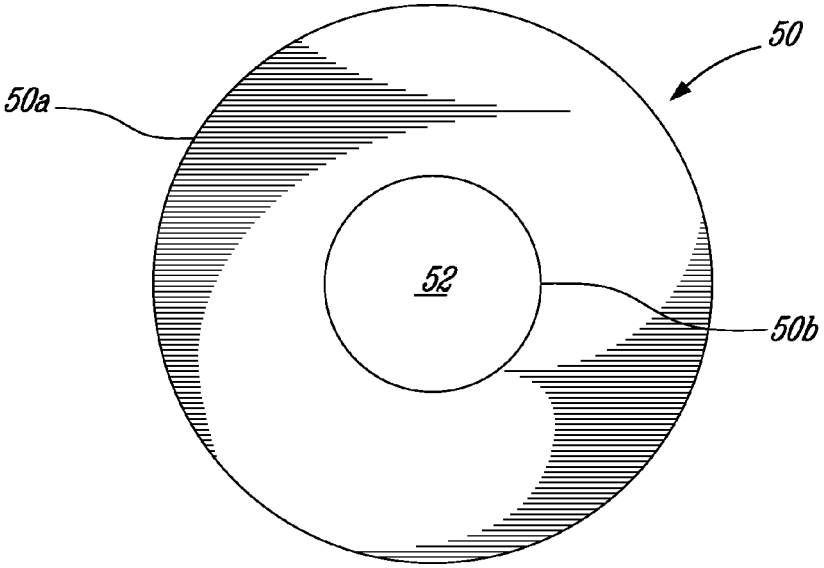
FIG. 6 is a semi-schematic view showing an example of a monolithic blank.

FIG. 5 is a semi-schematic view showing one of the strikers 34 of the apparatus 30 illustrated in FIG. 3 pressing against a blank 50 positioned at the front of the die 32. The other strikers 34 are omitted in FIG. 4 for clarity. In the method described herein, the strikers 34 are used substantially simultaneously. The blank 50 is made of monolithic and substantially annular sheet metal, as shown schematically in FIG. 6. The outer edge 50*a* of the blank 50 will correspond to the trailing end of the turbofan mixer 20 to be shaped. The edge 50*b* surrounding the center hole 52 of the blank 50 will correspond to the leading edge of the turbofan mixer 20. It should be noted that variants in the initial shape of the blank 50 are possible.

To shape the blank 50 into a turbofan mixer 20, the center of the blank 50 is set against the front side of the die 32, for instance coaxially with reference to the central axis 42. The blank 50 is held in that position using a suitable holding arrangement. For instance, the blank 50 can be held by the inner tips of the strikers 34 abutting against the front side of the blank 50. Other arrangements are possible as well. The strikers 34 are then moved substantially simultaneously in a radial plane towards the rear and the central axis 42 of the die to draw the blank 50. The lobes 24, 26 will be formed as the strikers 34 move towards the end of their stroke, thereby forcing the sheet metal wall of the blank 50 over the die surface.

Each striker 34 follows a direction that is somehow oblique with reference to the central axis 42 of the die 32, although it does not necessarily need to be in perfect alignment therewith. Arrow 60 in FIG. 3 shows the general direction for the striker 34. Each striker 34 is mounted and actuated in the apparatus 30 using a suitable arrangement, which arrangement is schematically depicted with reference numeral 62. For instance, each striker 34 can be mounted in a rail and can be connected to a hydraulic actuator that provides the force to move the striker 34. Other arrangements are possible as well.

As can be appreciated, forming turbofan mixers 20 using the apparatus 30 and the method described herein can be made quickly and very efficiently. A turbofan mixer can even be shaped in a single pressing stroke, depending on the exact configuration.

The above description is meant to be exemplary only, and one skilled in the art will recognize that changes may be made to the embodiments described without departing from the scope of the invention disclosed. For instance, the exact shape of the turbofan mixer can be different from the one illustrated. The shape of the die, the shape of the strikers and the shape of the blank can be different as well. When moving the strikers simultaneously, some can be slightly delayed in their initial movement and the speed of all strikers need not necessarily be the same. Strikers can get to the end of their stroke at slightly different intervals and the speed of their movement can vary during the forming. Still, the relative position of the strikers at the beginning and/or at the end of their stroke may not be the same. Strikers can have a different angle with reference to the central axis of the die compared to others. The movements of some or of all strikers do not necessarily need to be entirely linear and variants are possible. Once formed, the turbofan mixers can be subjected to additional manufacturing procedures, if required, for instance heat treatments, coatings, etc. Other modifications which fall will be apparent to those skilled in the art, in light of a review of this disclosure, and such modifications are intended to fall within the appended claims.

What is claimed is:

1. A method of forming a turbofan mixer, the method comprising:

providing a single monolithic and generally flat annular sheet metal blank;

providing a die surface substantially corresponding in shape to a turbofan mixer shape, the die surface including outwardly-projecting and circumferentially disposed lobes, each two adjacent of said lobes having a respective channel therebetween;

positioning the blank with reference to the die surface by aligning a hole of the annular blank with an end of the die surface;

forcing the entire circumference of blank against the die surface with the end of the die surface aligned with the hole by pressing a plurality of strikers against the blank substantially simultaneously to transform the blank into a tubular monolithic turbofan mixer having a plurality of circumferentially-disposed lobes on its circumferentially-outer surface; and removing the die surface from contact with a circumferentially-inner surface of the tubular monolithic turbofan mixer.

2. The method as defined in claim 1, wherein the die surface is provided around a substantially circular-shaped die having a central axis, the step of positioning the blank including aligning a center of the blank coaxially with reference to the central axis of the die.

3. The method as defined in claim 1, wherein the blank is forced against the die surface by applying a pressing force at a plurality of circumferentially-disposed locations on a side of the blank opposite the die surface.

4. The method as defined in claim 3, wherein each of the pressing forces is applied in a direction that is substantially towards a point located on the central axis and at a rear side of the die.

5. The method as defined in claim 4, wherein the turbofan mixer is formed in a single pressing stroke.

6. The method as defined in claim 1, wherein the die and the blank have axes coaxially aligned, and wherein the step of forcing comprising moving a striker parallelly to the axes to force the blank against the die surface.

* * * * *